United States Patent [19]

Suziki et al.

[11] 4,010,723

[45] Mar. 8, 1977

[54] EXHAUST GAS CLEANING APPARATUS FOR AN INTERNAL COMBUSTION ENGINE FOR A VEHICLE

[75] Inventors: Katsumi Suziki; Katsunori Kawatake; Hiroshi Sawada; Hiroki Matsuoka, all of Susono, Japan

[73] Assignee: Toyota Jidosha Kogyo Kabushiki Kaisha, Toyota, Japan

[22] Filed: Dec. 30, 1975

[21] Appl. No.: 645,392

[30] Foreign Application Priority Data

Oct. 15, 1975 Japan ..... 50-124132

[52] U.S. Cl. ..... 123/119 A; 261/121 B

[51] Int. Cl.² ..... F02M 25/06

[58] Field of Search ..... 123/119 A, 129 R; 261/121 A, 121 B

[56] References Cited

UNITED STATES PATENTS

| | | | |
|---|---|---|---|
| 3,906,910 | 9/1975 | Szlaga, Jr. | 123/119 D |
| 3,915,136 | 10/1975 | Caldwell | 123/119 A |
| 3,926,161 | 12/1975 | Wertheimer | 123/119 A |
| 3,948,236 | 4/1976 | Nartowski | 123/124 R |
| 3,951,115 | 4/1976 | Brisko | 123/119 A |
| 3,970,052 | 7/1976 | Andoh | 123/119 A |

*Primary Examiner*—Wendell E. Burns
*Attorney, Agent, or Firm*—Stevens, Davis, Miller & Mosher

[57] ABSTRACT

An exhaust gas cleaning apparatus for an internal combustion engine for a vehicle having a carburetor including an air bleed system to bleed air into a fuel line of said carburetor, and having an exhaust gas recirculation valve including a diaphragm mechanism which is controlled by negative pressure in said carburetor to recirculate a part of said exhaust gas from the exhaust manifold to the intake manifold.

The apparatus comprises another air bleed system to bleed air to the fuel line of the carburetor and valve means for communicating said other air bleed system and said diaphragm mechanism of the exhaust gas recirculation valve with the atmosphere in response to negative pressure in the venturi of said carburetor and in the intake manifold.

4 Claims, 3 Drawing Figures

EXHAUST GAS CLEANING APPARATUS FOR AN INTERNAL COMBUSTION ENGINE FOR A VEHICLE

BACKGROUND OF THE INVENTION

The present invention relates to an exhaust gas cleaning apparatus for an internal combustion engine for a vehicle having an exhaust gas recirculation valve which is controlled by negative pressure in the carburetor to recirculate a part of the exhaust gas into the intake manifold.

It is well known that the amount of nitrogen oxides ($NO_x$) in toxic components in the exhaust gas from an internal combustion engine, which amount is extremely increased during engine accelerating operation, is decreased by supplying a rich air-fuel mixture to the engine cylinder or by recirculating a part of the exhaust gas to the intake manifold from the exhaust manifold. However, the supplying operation of rich air-fuel mixture allows inferior fuel consumption efficiency of the engine, and recirculating operation allows inferior "drive ability" of the engine.

SUMMARY OF THE INVENTION

An object of the present invention is to provide an exhaust gas cleaning apparatus for an internal combustion engine, which can decrease $NO_x$ amounts in exhaust gas to a required level during the engine accelerating operation.

Another object of the invention is to provide an exhaust gas cleaning apparatus for an internal combustion engine, in which said recirculating operation in the intake manifold of a part of the exhaust gas is attained only when the engine is being accelerated to prevent inferior drive ability of the engine when the engine is operating at a constant speed.

A further object of the present invention is to provide an exhaust gas cleaning apparatus for an internal combustion engine whereby both said supplying operation of the rich air-fuel mixture to the engine and said recirculating operation in the intake manifold of a part of the exhaust gas can be attained during said engine accelerating operation to prevent inferior drive ability of the engine during engine accelerating operation and to maintain good fuel consumption efficiency of the engine.

According to the present invention, an exhaust gas cleaning apparatus is provided for an internal combustion engine of a vehicle having a carburetor which includes an air bleed system to bleed air into a fuel line of said carburetor and having an exhaust gas recirculation valve including a diaphragm mechanism which is controlled by negative pressure in said carburetor so as to recirculate a part of said exhaust gas from the exhaust manifold to the intake manifold, said apparatus comprising: another air bleed system to bleed air into the fuel line of said carburetor; and valve means for communicating said other air bleed system and said diaphragm mechanism of the exhaust gas recirculation valve with the atmosphere, in response to negative pressure in the venturi of said carburator and in said intake manifold. As a result of the arrangement of this invention, a part of the exhaust gas is recirculated to the intake manifold and a rich airfuel mixture is supplied to the engine cylinder when the engine is in an accelerating operation, so that the amount of said $NO_x$ component in the engine exhaust is effectively decreased to a large extent.

BRIEF DESCRIPTION OF THE DRAWINGS

The invention will now be described with reference to the accompanying drawings in which.

DETAILED DESCRIPTION OF THE PREFERRED EMBODIMENT

Figure 1:
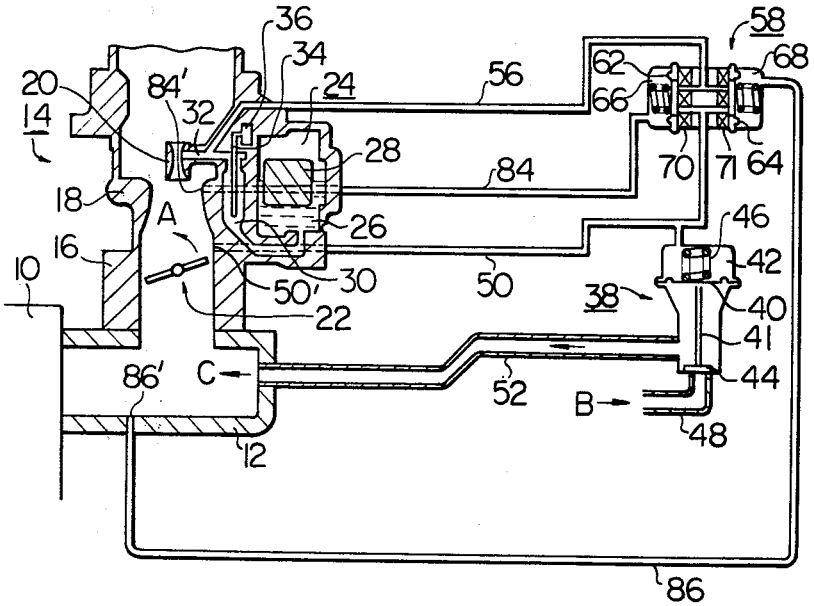
FIG. 1 shows a schematic view of an exhaust gas cleaning apparatus, according to the invention.

In FIG. 1, an exhaust gas cleaning apparatus for an internal combustion engine for a vehicle, according to the present invention is shown. Said engine has an engine body 10 to which an intake manifold 12 is connected and has a carburetor 14 which is connected to said intake manifold 12. In an inner surface of a barrel 16 of the carburetor 14, a large venturi 18 and a small venturi 20 which is arranged near said large venturi 18 are provided. Drown stream, from said large venturi 18 a throttle valve 22 of the carburetor 14 is provided, which is opened or closed in response to movement of the accelerator pedal (not shown) of the vehicle. A float chamber 24 is formed at one side of said barrel 16. A float 28 is arranged in said float chamber 24, to maintain a constant level of fuel 26 therein. Said float chamber 24 is connected to a main nozzle 32 through a passageway 30 defined in one side of the barrel 16. Said nozzle 32 is connected to the small venturi 18 so as to spray the air-fuel mixture. Carburetor 14 further includes an air bleed system having an emulsion tube 34, the lower end of which extends into said passageway 30 and upper end of which extends to a hole 36 which is open to the atmosphere. The main air bleed system serves to equalize the air-fuel ratio during each type of operation of the engine and serves to improve atomization of fuel in said passageway 30.

The exhaust gas cleaning apparatus according to the present invention further includes an exhaust gas recirculation valve (EGR valve) 38 having a diaphragm mechanism which is controlled by negative pressure in the carburetor 14 so as to recirculate a part of the exhaust gas from the exhaust manifold to the intake manifold. Said EGR valve 38 has a casing 39, a diaphragm 40, a valve rod 41, and a valve member 44 connected to said rod 41. Said diaphragm 40 is urged downwardly by a coil spring 46 which is arranged in a chamber 42 defined in the casing 39. Said valve member 44 serves to communicate a pipe 48 which is connected to said exhaust manifold (not shown) with a pipe 52 which is connected to said intake manifold 12 for the recirculation of a part of the exhaust gas as mentioned above in response to negative pressure in carburetor 14. Said vacuum chamber 42 is connected to a port 50' which is formed in an inner surface of the carburetor barrel 16 through a line 50. Said port 50' is positioned upstream from the throttle valve 22 which is closed, as shown in FIG. 1. In this closed position, there is no vacuum in the vacuum chamber 42, so that valve member 44, influenced by the action of the spring 46, interrupts the communication between pipe 48 and pipe 52. Because of this interruption, no exhaust gas is returned to the intake manifold 12. When throttle valve 22 is opened as shown by arrow A on the other hand, negative pressure in the carburetor barrel 16 is transmitted to chamber 42 through said line 50. Thus, the diaphragm 40 (in other words, valve member 44) is displaced upwardly against said spring 46, so that communication between pipe 48 and pipe 52 is again established. In this way, a part of the exhaust gas introduced into pipe 48 as shown by arrow B from the exhaust manifold, is recirculated to the exhaust manifold 12 through said pipe 52, as shown by arrow C.

In addition to the above-mentioned air bleed system, the exhaust gas cleaning apparatus according to the present invention further includes a second air bleed system adapted for the reduction of said $NO_x$ component in exhaust gas. Said second air bleed system includes an air bleed pipe 56, one end of which is connected to the main nozzle 32. The other end of said air bleed pipe 56 is opened or closed to the atmosphere by an air valve 58 which will hereinafter be fully explained. When the engine is in a normal operating condition, said valve 58 causes said pipe 56 to open to the atmosphere in order to such air into the nozzle 32. In this condition the amount of air which is supplied to the nozzle 32 through the pipe 56 is determined so that an air-fuel mixture having an air-fuel ratio which is ideal to the engine operation, is supplied to the intake manifold 12. When the engine is in an accelerating condition, valve 58 closes pipe 56 to the atmosphere, so that a rich air-fuel mixture can be supplied to the engine.

Figure 2:
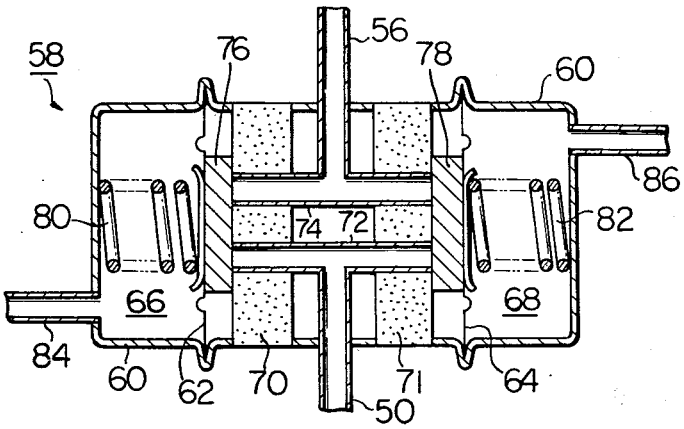
FIG. 2 shows an enlarged view of a part FIG. 1, in which an air valve according to the invention is in its closed position.

In FIG. 2, an enlarged view of said air valve 58 in FIG. 1 is shown. In order to effectively reduce the mount of $NO_x$ components in the exhaust gas when the engine is being accelerated, said valve 58 serves to close said pipe 56 to the atmosphere so as to supply a rich air-fuel mixture to the engine, and also serves to operate EGR valve 38 in order to recirculate a part of said exhaust gas in the intake manifold 12. Said valve 58 includes a casing 60 and two diaphragms 62 and 64 which are secured to said casing 60 so as to form two vacuum chambers 66 and 68 therein. In said casing, two air filtering plates 70 and 71 are arranged, and two branch pipes 72 and 74 are arranged therethrough, respectively. Said branch pipe 72 is connected to said pipe 50 which is connected to vacuum chamber 42 of the EGR valve 38. The other branch pipe 74 is connected to air bleed pipe 56 which is connected to the main nozzle 32 of the carburetor 14.

One end of each of branch pipes 72 and 74 face valve member 76 while the other two ends face valve member 78, and said valve members are secured to diaphragms 62 and 64, respectively. Valve members 76 and 78 are urged toward the ends of said branch pipes 72 and 74 by coil springs 80 and 82 which are arranged in chambers 66 and 68, respectively. Said vacuum chamber 66 is connected, to a port 84' which is formed in the large venturi 18 near the small venturi 20, through a vacuum line 84. Said other vacuum chamber 68 of the valve 58 is connected to a port 86' formed in the intake manifold 12 near to the engine body 10, through a vacuum line 86.

Figure 3:
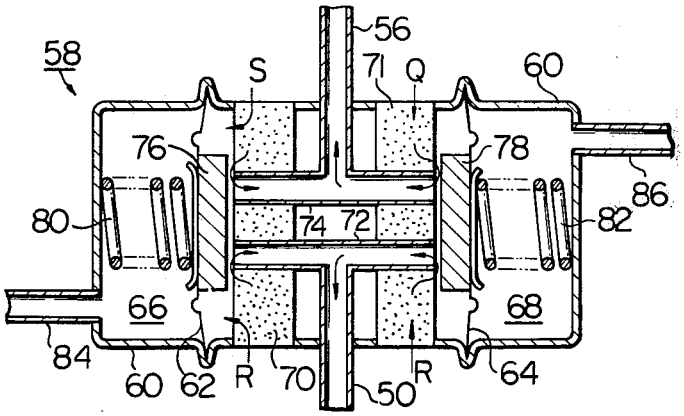
FIG. 3 shows said air valve in its open position.

The above-mentioned exhaust gas cleaning apparatus according to the invention of the present application operates as follows. When the engine is operating at a constant speed, the throttle valve 22 is only slightly opened from the closed position thereof, as shown in FIG. 1. Therefore, negative pressure in the intake manifold 12 increases. This increased negative pressure is sent through said port 86' and line 86, to the vacuum chamber 68 of the air valve 58. As a result thereof, valve member 78 is displaced as shown in FIG. 3, against the spring 82 so that vacuum chamber 42 of the EGR valve 38 is opened to the atmosphere through the air filter 71, the branch pipe 72 and the line 50, as shown by arrow P. Thus, the diaphragm 40 (valve member 44) is in the position shown in FIG. 1, in which communication between said pipe 48 connected to the exhaust manifold and said pipe 52 connected to the intake manifold, 12 is interrupted. In this way, the recirculation of the exhaust gas can not attained. At the same time, a certain amount of the air is supplied to the main nozzle 32 of the carburetor 14 through the air filter 71, the branch pipe 74 and the air bleed pipe 56, as shown by arrow Q. Therefore, the air-fuel ratio of the air-fuel mixture in the intake manifold 12 can be maintained at a value which is ideal to the particular engine operation.

When the engine is being accelrated, the throttle valve 22 is fully opened. As a result thereof, negative pressure in the intake manifold 12 which is transmitted to the vacuum chamber 68 of the valve 58 through the port 86' and to the negative pressure line 86, is decreased in order to return the valve member 78 to the position shown in FIG. 2, in which position, line 50 is closed to the atmosphere. In the initial stage of the engine accelerating operation, the speed of the air-fuel mixture from the small venturi 20, in other words negative pressure in the port 84' is small enough to keep the valve member 76 in the position shown in FIG. 2, in which position both ends of the branch pipes 72 and 74 are closed by the valve member 76 because of the action of the spring 80. As a result, negative pressure in the carburetor barrel 16 can be transmitted to the vacuum chamber 42 of the EGR valve 38 so as to displace the diaphragm 40 (in other words, the valve member 44) upwardly to a position in which a part of the exhaust gases from the exhaust manifold is recirculated in the intake manifold 12 through the pipe 48 as shown by arrow B, and through the pipe 52, as shown by arrow C. At the same time, air is not supplied through the pipe 56 to the nozzle 22 of the carburetor 14, because said pipe 56 is closed to the atmosphere by valves 76 and 78. Thus, a rich air-fuel mixture is supplied to the intake manifold 12. As is clear from the above explanation, both the recirculation operation of the exhaust gas and the supplying operation of the rich air-fuel mixture can be attained in the initial stage of the accelerating operation of the engine, so that the amount of the $NO_x$ components is said exhaust gas is effectively reduced to a large extent.

After the initial stage of the accelerating operation of the engine, the flow speed of the air-fuel mixture from the small venturi 20 is increased. Therefore, negative pressure in the large venturi 18 which is transmitted to the vacuum chamber 66 of the valve 58 through the port 84' and through the line 84 increases to such an extent that it displaces the diaphragm 62, as shown in FIG. 3 against the spring 80 so as to open the valve member 76 from the branch pipes 72 and 74. As a result, the vacuum chamber 42 of the EGR valve 38 is connected to the atmosphere through the air filter 70, the branch pipe 72, and the line 50, as shown by arrow R, so that the diaphragm 40 of the EGR valve 38 is displaced downwardly to the position shown in FIG. 1 by the spring 46, in which position, the communication between the pipe 48 connected to the exhaust manifold 12 and the pipe 52 connected to the intake manifold 12 is interrupted by the valve member 44 to stop the recirculation of the exhaust gas. At the same time, a certain amount of air is supplied to the nozzle 32 through the filter 70, the branch pipe 74 and the pipe 56, as shown by arrow S, in order to decrease the air/fuel ratio of said air-fuel mixture in the intake manifold 12 to value which is ideal for the particular engine operation.

In the above mentioned embodiment negative pressures in the venturi and the intake manifold are independently used to detect engine accelerating operation. However, a combined negative pressure in the intake manifold and the venturi of the carburetor may be used to detect engine accelerating operation.

While only one embodiment of the invention has been described herein, various changes and modifications may be made without departing from the scope of the invention.

What is claimed is:

1. An exhaust gas cleaning apparatus for an internal combustion engine for a vehicle having a carburetor including an air bleed system to bleed air to a fuel line of said carburetor, and having an exhaust gas recirculation valve including a diaphragm mechanism which is controlled by negative pressure in said carburetor so as to recirculate a part of said exhaust gas from the exhaust manifold in the intake manifold, said apparatus comprising: a second air bleed system to bleed air to the fuel line of said carburetor; and valve means for communicating said second air bleed system and said diaphragm mechanism of the exhaust gas recirculation valve with the atmosphere, in response to negative pressure in the venturi of said carburetor and intake manifold, thereby both the recirculating operation of a part of the exhaust gas and the supplying operation of a rich air-fuel mixture to the engine can be attained during the accelerating operation of the vehicle.

2. An exhaust gas cleaning apparatus according to claim 1, wherein said valve means comprises: a casing; a first diaphragm means mounted at one side of said casing and operable by negative pressure in said venturi of said carburetor, second diaphragm means mounted at the other side of said casing and operable by negative pressure in the engine intake manifold, a first pipe member arranged in said casing and opened at both ends, said first pipe member being connected to a vacuum chamber of the diaphragm mechanism of the exhaust gas recirculation valve; a second pipe member which is arranged in the casing and which is opened at both ends, said second pipe member being connected to the second air bleed system, a first valve member which is connected to the first diaphragm means so as to communicate one end of each of said first and second pipe members with the atmosphere in response to the negative pressure in the venturi of the carburetor, and a second valve member which is connected to the second diaphragm means so as to communicate the other ends of said first and second pipe member with the atmosphere in response to the vacuum in the engine intake manifold.

3. An exhaust gas cleaning apparatus according to claim 2, wherein said first diaphragm means has a vacuum chamber which is connected to a port defined in the venturi of the carburetor.

4. An exhaust gas cleaning apparatus according to claim 2, wherein said second diaphragm means has a vacuum chamber which is connected to a port defined in the engine intake manifold.

* * * * *